US012420378B2

(12) United States Patent
Hiroo et al.

(10) Patent No.: US 12,420,378 B2
(45) Date of Patent: Sep. 23, 2025

(54) SUBSTRATE PROCESSING APPARATUS AND METHOD FOR CONTROLLING DRESSING OF POLISHING MEMBER

(71) Applicant: EBARA CORPORATION, Tokyo (JP)

(72) Inventors: Yasumasa Hiroo, Tokyo (JP); Keita Yagi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 71 days.

(21) Appl. No.: 17/398,684

(22) Filed: Aug. 10, 2021

(65) Prior Publication Data

US 2022/0048160 A1 Feb. 17, 2022

(30) Foreign Application Priority Data

Aug. 11, 2020 (JP) ..... 2020-135750

(51) Int. Cl.
*B24B 53/017* (2012.01)

(52) U.S. Cl.
CPC ..... *B24B 53/017* (2013.01)

(58) Field of Classification Search
CPC ..... B24B 37/042; B24B 37/107; B24B 37/34; B24B 37/20; B24B 37/005; B24B 49/00;
(Continued)

(56) References Cited

U.S. PATENT DOCUMENTS

2003/0045207 A1* 3/2003 Taylor ..... B24B 49/18 451/6
2004/0248411 A1 12/2004 Ushio et al.
(Continued)

FOREIGN PATENT DOCUMENTS

CN 102131617 A 7/2011
CN 111230729 A 6/2020
(Continued)

OTHER PUBLICATIONS

Interpolation_NPL (https://sciencing.com/interpolate-numbers-8680223.html) (Year: 2017).*

*Primary Examiner* — David S Posigian
*Assistant Examiner* — Jacob Adam Montgomery
(74) *Attorney, Agent, or Firm* — BakerHostetler

(57) ABSTRACT

A substrate processing apparatus that polishes a substrate by sliding the substrate on a polishing member, the substrate processing apparatus including a dresser that dresses the polishing member by swinging on the polishing member, the dresser being enabled to adjust a swing speed in a plurality of scanning areas set on the polishing member along a radial direction, a height detection section that measures a surface height of the polishing member along the radial direction of the polishing member and thereby generates a pad profile, a dresser load setting section that sets a dresser load to be applied by the dresser to the polishing member, a pad height correction section that calculates an amount of correction of the surface height of the polishing member according to an amount of variation from a reference load of the dresser load over the radial direction, corrects the measured value of the surface height with the amount of correction and thereby corrects the pad profile, and a moving speed calculation section that adjusts the swing speed of the dresser in each scanning area based on the corrected pad profile.

8 Claims, 14 Drawing Sheets

(58) Field of Classification Search
CPC ..... B24B 49/006; B24B 49/04; B24B 49/18; B24B 49/186; B24B 49/02; B24B 53/017; B24B 53/12; B24B 7/228; H01L 21/67092
USPC ..... 451/5, 21, 22, 72, 443
See application file for complete search history.

(56) References Cited

U.S. PATENT DOCUMENTS

2004/0259470 A1* 12/2004 Swedek ..... B24B 37/013 451/41
2011/0136414 A1 6/2011 Masumura et al.
2011/0281501 A1* 11/2011 Qian ..... B24B 49/12 451/6
2012/0270477 A1* 10/2012 Nangoy ..... B24B 53/017 451/443
2014/0065931 A1* 3/2014 Shinozaki ..... B24B 49/18 451/72
2014/0287653 A1 9/2014 Shimano et al.
2015/0147829 A1* 5/2015 Benvegnu ..... B24B 49/04 451/5
2019/0009385 A1* 1/2019 Hiroo ..... B24B 49/105
2019/0160626 A1* 5/2019 Watanabe ..... B24B 37/013
2019/0160628 A1* 5/2019 Lee ..... B24B 49/12
2020/0061774 A1* 2/2020 Matsushita ..... B24B 53/017
2020/0164486 A1 5/2020 Che
2020/0198094 A1 6/2020 Yagi et al.
2022/0410345 A1 12/2022 Yagi et al.

FOREIGN PATENT DOCUMENTS

CN 111496668 A 8/2020
JP 2003-068688 A 3/2003
JP 2014-161944 A 9/2014
JP 2020-028955 A 2/2020
JP 2020-099966 A 7/2020
JP 2020-104196 A 7/2020

* cited by examiner (a)

(b)

SUBSTRATE PROCESSING APPARATUS AND METHOD FOR CONTROLLING DRESSING OF POLISHING MEMBER

CROSS-REFERENCE TO RELATED APPLICATIONS

This application claims the benefit of Japanese Priority Patent Application No. 2020-135750 filed on Aug. 11, 2020, the entire contents of which are incorporated herein by reference.

FIELD

The present invention relates to a method for controlling dressing of a polishing member that polishes a substrate and a substrate processing apparatus.

BACKGROUND

Polishing using a chemical-mechanical polishing (CMP) apparatus is one of methods for flattening a surface of a substrate for forming a semiconductor device. The chemical-mechanical polishing apparatus includes a polishing member (a polishing cloth, a polishing pad or the like) and a holding section (a top ring, a polishing head, a chuck or the like) that holds a polishing target such as a substrate. By pushing the surface (polished surface) of the polishing target against the surface of a polishing member, and causing the polishing member and the polishing target to relatively move while supplying a polishing liquid (abrasive liquid, chemical liquid, slurry, pure water or the like) between the polishing member and the polishing target, the surface of the polishing target is polished to a flat surface.

As the material of the polishing member, foamed resin or non-woven fabric cloth is commonly used. Minute irregularities are formed on the surface of the polishing member and these minute irregularities act as chip pockets, which are effective for preventing clogging or reducing polishing resistance. However, continuation of polishing of a polishing target using the polishing member causes minute irregularities on the surface of the polishing member to be crushed, leading to reduction in a polishing rate. For this reason, the surface of the polishing member is periodically dressed using a dresser obtained by electro-depositing many abrasive grains of diamond particles or the like and the minute irregularities are re-formed on the surface of the polishing member.

An example of the method for dressing the polishing member is performing dressing while moving a rotating dresser (arcuate or rectilinear reciprocating or swinging motion), pressing the dressing surface against the rotating polishing member. When dressing the polishing member, the surface of the polishing member is shaved, albeit in a small amount. Therefore, if dressing is not performed appropriately, inappropriate undulation may occur on the surface of the polishing member, which may cause variation in the polishing rate on the polished surface. The variation in the polishing rate may result in polishing defects, and so it is necessary to perform dressing appropriately so as not to cause inappropriate undulation on the surface of the polishing member. It is possible to suppress variations in the polishing rate by adjusting conditions (dressing conditions) such as the rotation speed of the polishing member, the rotation speed of the dresser or the moving speed of the dresser.

For example, a polishing apparatus described in Japanese Patent Application Laid-Open No. 2014-161944 sets a plurality of swing sections along a swing direction of a dresser, calculates a difference between a profile of a current polishing pad obtained from a measured value of a surface height of the polishing member during each swing section and a profile of a target polishing pad and corrects the moving speed of the dresser at each swing section so as to eliminate the difference.

A polishing apparatus described in Japanese Patent Application Laid-Open No. 2020-28955 calculates, when a load (dressing load) applied to the polishing pad at the time of dressing is changed, an amount of correction of the dresser height according to the amount of change from a reference dressing load and corrects a measured value of the dresser height (polishing pad height).

SUMMARY OF THE INVENTION

When a dressing load is changed (for example, when a dressing load is increased), the polishing pad is pressed by that amount, and so the measured value of the polishing pad height is reduced. However, the amount of change in the polishing pad height is not constant over the whole surface of the polishing pad, and the amount of change in the height may differ between, for example, the center of the polishing pad and the periphery. For this reason, when the dressing load is changed, the intended height profile cannot be obtained over a radial direction of the polishing member.

An aspect of the present invention is a substrate processing apparatus that polishes a substrate by sliding the substrate on a polishing member, the substrate processing apparatus including a dresser that dresses the polishing member by swinging on the polishing member, the dresser being enabled to adjust a swing speed in a plurality of scanning areas set on the polishing member along a radial direction, a height detection section that measures a surface height of the polishing member along the radial direction of the polishing member and thereby generates a pad profile, a dresser load setting section that sets a dresser load to be applied by the dresser to the polishing member, a pad height correction section that calculates an amount of correction of the surface height of the polishing member according to an amount of variation from a reference load of the dresser load over the radial direction, corrects the measured value of the surface height with the amount of correction and thereby corrects the pad profile, and a moving speed calculation section that adjusts the swing speed of the dresser in each scanning area based on the corrected pad profile.

Another aspect of the present invention is a method for dressing a polishing member used for a substrate polishing apparatus by swinging a dresser on the polishing member, the dresser being enabled to adjust a swing speed in a plurality of scanning areas set on the polishing member along a swing direction, the method including a measuring step of measuring a surface height of the polishing member along a radial direction of the polishing member and thereby generating a pad profile, a dresser load setting step of setting a dresser load to be applied by the dresser to the polishing member, a pad height correcting step of calculating an amount of correction of a surface height of the polishing member according to an amount of variation from a reference load of the dresser load over the radial direction, correcting the measured value of the surface height with the amount of correction and thereby correcting the pad profile, and a moving speed calculating step of adjusting the swing speed of the dresser in each scanning area based on the corrected pad profile.

DETAILED DESCRIPTION OF NON-LIMITING EXAMPLE EMBODIMENT

Figure 1:
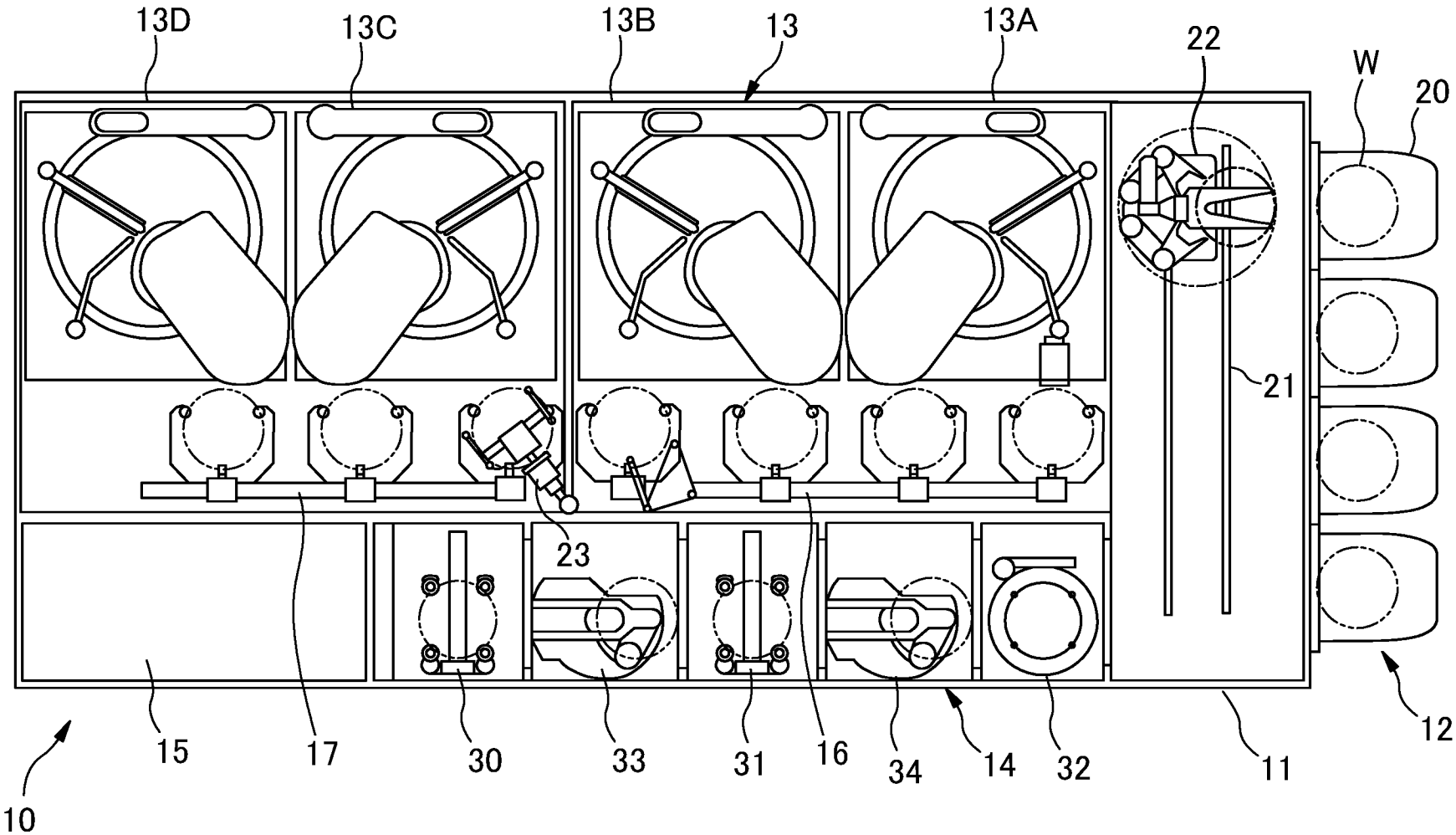
FIG. 1 is a plan view schematically illustrating a configuration of a substrate processing apparatus according to an embodiment of the present invention.

FIG. 1 is a plan view illustrating an overall configuration of a substrate processing apparatus. A substrate processing apparatus 10 is divided into a loading/unloading section 12, a polishing section 13 and a cleaning section 14, and these sections are provided in a housing 11. The substrate processing apparatus 10 is provided with an apparatus controller 15 that controls operation of processing such as substrate transport, polishing and cleaning.

The loading/unloading section 12 is provided with a front loading section 20 on which substrate cassettes for stocking many substrates W are placed, a traveling mechanism 21 and a transport robot 22. The transport robot 22 is provided with two hands in a vertical direction and performs operations such as taking out the substrate W in the substrate cassette placed on the front loading section 20 and sending the substrate W to the polishing section 13 and returning a substrate which has already been processed and sent from the cleaning section 14 to the substrate cassette by moving on the traveling mechanism 21. Note that the substrate W may typically be a circular wafer.

The polishing section 13 is provided with a plurality of polishing apparatuses 13A to 13D that perform polishing (flattening process) on a substrate and the polishing apparatuses are arranged in a longitudinal direction of the substrate processing apparatus. First and second linear transporters 16 and 17 are provided between the polishing section 13 and the cleaning section 14 as transport mechanisms to transport the substrate W. The first linear transporter 16 can freely move between a first position to receive the substrate W from the loading/unloading section 12, second and third positions to deliver the substrate W between the polishing units 13A and 13B and a fourth position to deliver the substrate W to/from the second linear transporter 17.

The second linear transporter 17 can freely move between a fifth position to receive the substrate W from the first linear transporter 16, and sixth and seventh positions to deliver the substrate W between the polishing units 13C and 13D. A swing transporter 23 to send the substrate W from the fourth position or the fifth position to the cleaning section 14 and from the fourth position to the fifth position is provided between the transporters 16 and 17.

The cleaning section 14 is provided with a first substrate cleaning apparatus 30, a second substrate cleaning apparatus 31, a substrate drying apparatus 32 and transport robots 33 and 34 to deliver the substrate between these apparatuses. The substrate W to which a polishing process has been applied by the polishing apparatus is cleaned (primary cleaning) by the first substrate cleaning apparatus 30 and then is further cleaned (finish cleaning) by the second substrate cleaning apparatus 31. The cleaned substrate is transported from the second substrate cleaning apparatus 31 to the substrate drying apparatus 32 and subjected to spin drying. The dried substrate W is taken out by the transport robot 22 and returned to the substrate cassette placed on the front loading section 20.

Figure 2:
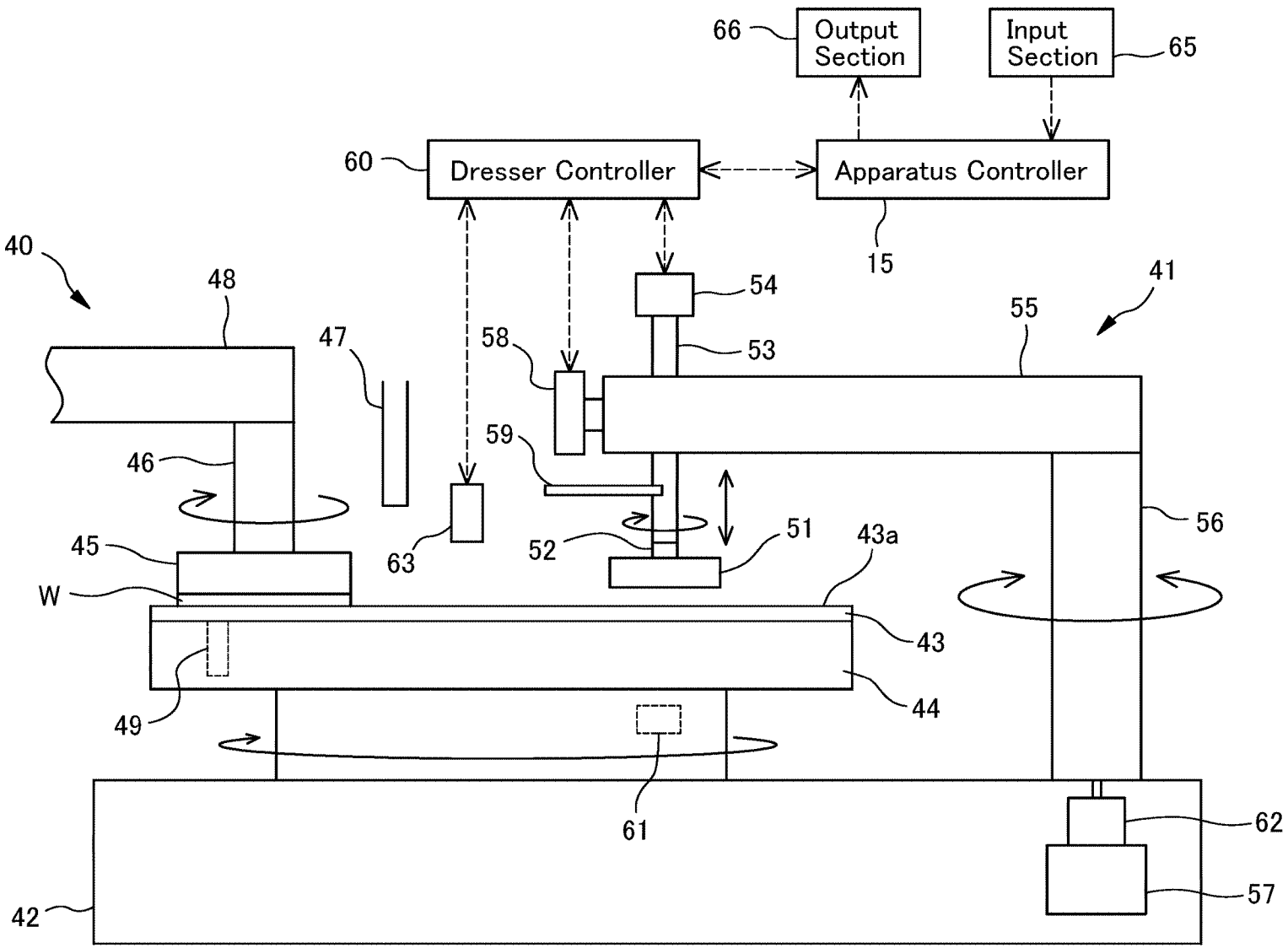
FIG. 2 is a schematic view illustrating a polishing apparatus that polishes a substrate.

As shown in FIG. 2, the individual polishing apparatuses 13A to 13D provided in the polishing section 13 are provided with a polishing unit 40 that performs polishing of the substrate W and a dressing unit 41 that performs conditioning (dressing) of the polishing pad 43 used for polishing of the substrate W. The polishing unit 40 and the dressing unit 41 are disposed on a base 42.

The polishing unit 40 is provided with a polishing pad (polishing member) 43, a polishing table 44 that holds the polishing pad 43, a top ring (substrate holding section) 45 connected to a bottom end of a top ring shaft 46 and a polishing liquid supply nozzle 47 that supplies a polishing liquid onto the polishing pad 43.

The top ring 45 is configured to hold the substrate W to an undersurface thereof by vacuum suction. The top ring shaft 46 is driven by a motor (not shown) to rotate, and this causes the top ring 45 and the substrate W to rotate. The top ring shaft 46 is connected to a rotatable top ring arm 48 and when the top ring arm 48 is driven by a motor (not shown) to rotate, the top ring 45 moves between a polishing position where polishing of the substrate W is performed and an attachment/detachment position where the substrate W is attached/detached. The top ring 45 is configured to move up and down with respect to the polishing pad 43 by a vertical movement mechanism (not shown) (e.g., vertical movement mechanism constructed of a servo motor, a ball screw or the like).

The polishing table 44 is rotated around a shaft center thereof by a motor (not shown) disposed therebelow. The polishing pad 43 is attached to a top surface of the polishing table 44 and a top surface of the polishing pad 43 constitutes a polishing surface 43*a* that polishes the substrate W. For example, foamed resin or a non-woven fabric cloth is used for the polishing pad 43, minute irregularities are formed on a surface of the polishing pad 43 (polishing surface 43*a*) acting as chip pockets effective in preventing clogging or reducing polishing resistance.

The polishing pad 43 performs polishing of the substrate W as follows. The top ring 45 and the polishing table 44 are made to rotate respectively and the polishing liquid supply nozzle 47 supplies the polishing liquid onto the polishing pad 43. In this condition, the top ring 45 that holds the substrate W is made to descend, and further, the substrate W is pressed against the polishing surface 43*a* of the polishing pad 43 using a pressurizing mechanism (not shown) made up of an airbag disposed in the top ring 45. The substrate W and the polishing pad 43 come into sliding contact with each other in the presence of the polishing liquid, and in this way, the surface of the substrate W is polished and flattened.

The polishing table 44 incorporates a film thickness sensor (film thickness measuring machine) 49 that measures a film thickness of the substrate W. As the film thickness sensor 49, a non-contact type sensor such as an eddy current sensor or an optical sensor can be used and a detection surface of the sensor is disposed so as to face the surface of the substrate W held to the top ring 45. The film thickness sensor 49 measures the film thickness of the substrate W while moving across the surface of the substrate W as the polishing table 44 rotates. Measured values of the film thickness are sent to a polishing controller (not shown) and a film thickness profile of the substrate W (film thickness distribution along a radial direction of the substrate W) is generated, and a polishing process of the substrate W is finished when a predetermined film thickness value is reached.

The dressing unit 41 is provided with a dresser 51 that comes into contact with the polishing surface 43*a* of the polishing pad 43, a dresser shaft 53 connected to the dresser 51 via a universal joint 52, an air cylinder 54 provided at a top end of the dresser shaft 53, and a dresser arm 55 that rotatably supports the dresser shaft 53. Abrasive grain such as diamond particles is fixed to an undersurface of the dresser 51. The undersurface of the dresser 51 constitutes a dressing surface for dressing the polishing surface 43*a* of the polishing pad 43.

As an aspect of the dressing surface, it is possible to apply a circular dressing surface (dressing surface with abrasive grain fixed to the entire undersurface of the dresser 51), a ring-shaped dressing surface (dressing surface with abrasive grain fixed to peripheral edges of the undersurface of the dresser 51) or a plurality of circular dressing surfaces (dressing surface with abrasive grain fixed to surfaces of a plurality of pellets of a small diameter arranged at substantially equal intervals around the dresser 51). Note that a circular dressing surface is provided for the dresser 51 according to the present embodiment.

The dresser shaft 53 and the dresser 51 are provided so as to be vertically movable with respect to the dresser arm 55. The air cylinder 54 is an apparatus that applies a pressure (dresser load) against the polishing pad 43 to the dresser 51 and it is possible to adjust the dresser load by adjusting an air pressure supplied to the air cylinder 54 through a dresser controller 60, which will be described later.

The dresser arm 55 is driven by a motor 57 so as to swing around a spindle 56. The dresser shaft 53 is rotated by a motor (not shown) disposed in the dresser arm 55, which causes the dresser 51 to rotate around a shaft center thereof. The air cylinder 54 presses the dresser 51 against the polishing surface 43*a* with a predetermined dresser load via the dresser shaft 53. The universal joint 52 is configured to transmit the rotation of the dresser shaft 53 to the dresser 51 while allowing the dresser 51 to tilt. In this way, even when the dresser shaft 53 is tilted a little with respect to the surface of the polishing pad 43, it is possible to allow the undersurface (dressing surface) of the dresser 51 to come into contact with the polishing pad 43 appropriately.

Dressing of the polishing surface 43*a* is performed as follows. While making the polishing table 44 and the polishing pad 43 rotate, a dressing liquid (e.g., pure water) is supplied from a dressing liquid supply nozzle (not shown) to the polishing surface 43*a* of the polishing pad 43. Furthermore, the dresser 51 is made to rotate around the shaft center thereof. The dresser 51 is pressed by the air cylinder 54 against the polishing surface 43*a* with a predetermined dresser load, causing the dressing surface of the dresser 51 to come into contact with the polishing surface 43*a*. In this condition, the dresser arm 55 is made to turn and the dresser 51 in contact with the polishing pad 43 is made to swing in a substantially radial direction of the polishing pad 43. In this way, the polishing surface 43*a* of the polishing pad 43 is shaved by the rotating dresser 51 and minute irregularities of the polishing surface 43*a* are re-formed.

A pad height sensor (surface height measuring machine) 58 to measure the height of the polishing surface 43*a* is fixed to the dresser arm 55. A sensor target 59 facing the pad height sensor 58 is fixed to the dresser shaft 53. The sensor target 59 is configured to move up and down integrally with the dresser shaft 53 and the dresser 51, but the position in the vertical direction of the pad height sensor 58 is fixed.

The pad height sensor 58 is, for example, a displacement sensor and detects the height of the dresser 51 connected to the sensor target 59 by measuring a displacement of the sensor target 59. Since the dresser 51 comes into contact with the polishing pad 43, it is possible to indirectly measure the height (thickness of the polishing pad 43) of the polishing surface 43*a* of the polishing pad 43 during a dressing process by measuring the dresser 51. As the pad height sensor 58, any type of sensor such as a linear scale sensor, a laser type sensor, an ultrasound sensor or an eddy current type sensor can be used.

The height of the polishing surface 43*a* is measured using the pad height sensor 58 in a plurality of predetermined regions ("monitoring area" in FIG. 5) divided in the radial direction of the polishing pad 43. An average of height of the polishing surface 43*a* in a region in contact with the undersurface (dressing surface) of the dresser 53 (predetermined monitoring area) is measured by the pad height sensor 58. By measuring the height of the polishing pad 43 in the plurality of monitoring areas, it is possible to obtain a height profile of the polishing pad 43 (cross-sectional shape of the height of the polishing surface 43*a*).

The pad height sensor 58 is connected to the dresser controller 60 and an output signal of the pad height sensor 58 (that is, measured value of the height of the polishing surface 43*a*) is sent to the dresser controller 60. The dresser controller 60 is configured to acquire a profile of the polishing pad 43 from the measured value of the height of the polishing surface 43*a*, and further determine whether or not dressing of the polishing pad 43 is performed correctly.

The polishing unit 41 is further provided with a table rotary encoder 61 that measures an angle of rotation of the polishing table 44 and the polishing pad 43 and a dresser rotary encoder 62 that measures a turning angle of the dresser 51. These table rotary encoder 61 and dresser rotary encoder 62 are absolute encoders that measure absolute values of angles and are connected to the dresser controller 60. The dresser controller 60 can acquire information on the angle of rotation of the polishing table 44 and the polishing pad 43 and further the turning angle of the dresser 51 at the time of height measurement of the polishing surface 43*a* by the pad height sensor 58.

A pad roughness measuring instrument 63 that measures surface roughness of the polishing pad 43 is disposed above the polishing pad 43. As the pad roughness measuring instrument 63, a publicly known non-contact type surface roughness measuring instrument of an optical type or the like can be used. The pad roughness measuring instrument 63 is connected to the dresser controller 60 and measured values of the surface roughness of the polishing pad 43 are sent to the dresser controller 60.

The dresser controller 60 is connected to the apparatus controller 15, performs a dresser process on the polishing pad by receiving a control signal from the apparatus controller 15 and also performs a polishing pad profile control process, which will be described later. An input section 65 such as a keyboard, a microphone or a tablet and an output section 66 such as a display or a speaker are connected to the apparatus controller 15. A control program to control operation of the substrate processing apparatus 10 may be installed in advance in a computer that constitutes the apparatus controller 15 or stored in a storage medium such as a CD-ROM or a DVD-ROM, or further installed in the apparatus controller 15 via the Internet. The apparatus controller 15 may also be provided for the substrate processing apparatus 10 or may be connected to the substrate processing apparatus 10 via a network.

Figure 3:
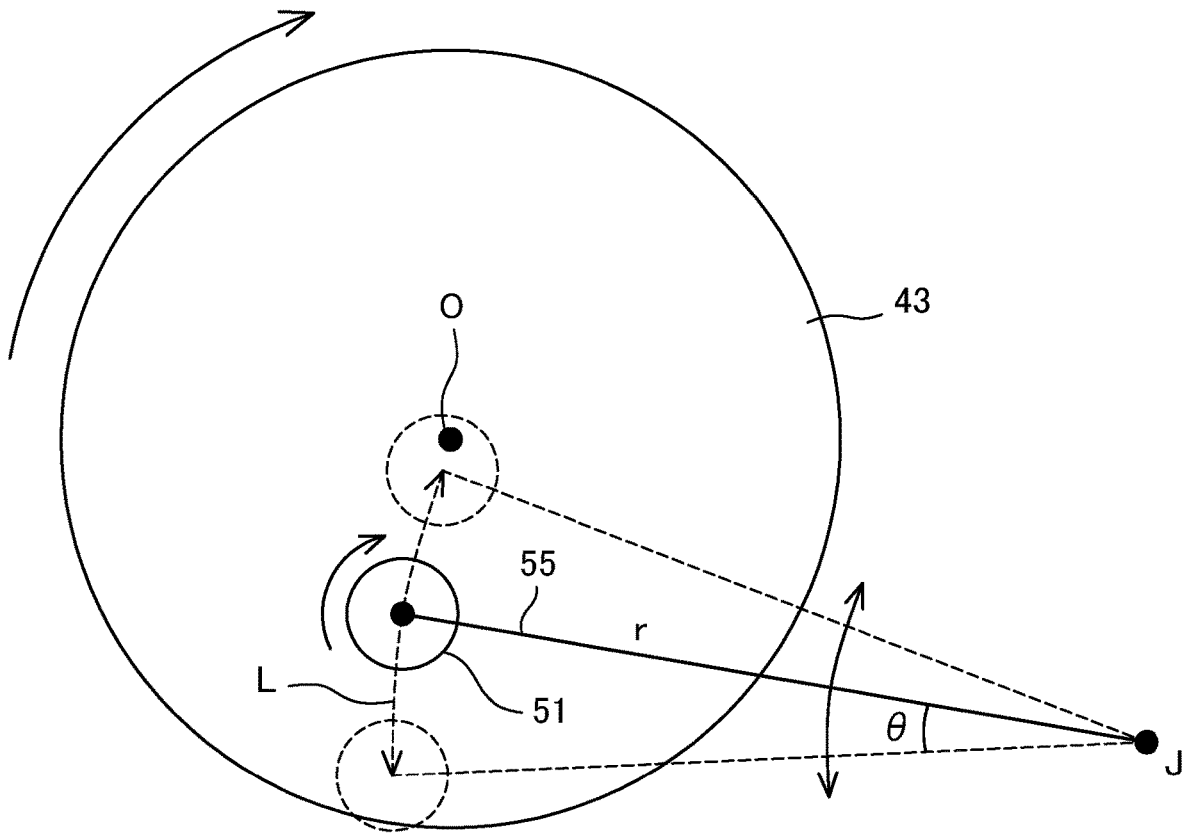
FIG. 3 is a plan view schematically illustrating a dresser and a polishing pad.

Next, swinging of the dresser 51 will be described with reference to FIG. 3. The dresser arm 55 (shown by a straight line for simplification of drawing) turns clockwise and counterclockwise around a point J by a predetermined angle. A position of the point J corresponds to a center position of the spindle 56 (see FIG. 2). Due to turning of the dresser arm 55, the center of rotation of the dresser 51 swings in the radial direction of the polishing pad 43 within a range shown by an arc L.

Figure 4:
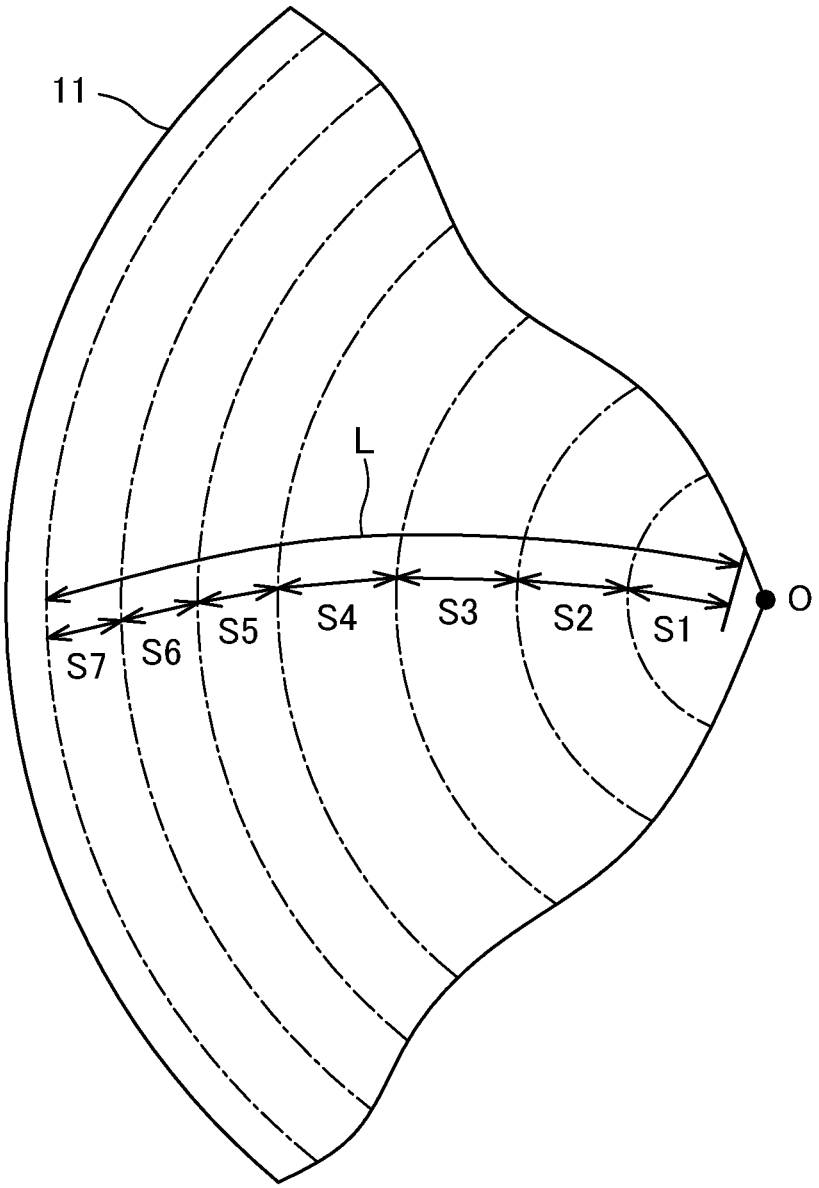
FIG. 4 is a diagram illustrating an example of scanning areas set on the polishing pad.

FIG. 4 is a partially enlarged view of the polishing surface 43*a* of the polishing pad 43. A swing range (swing width L) of the dresser 51 is divided into a plurality of (7 areas in the example in FIG. 4) scanning areas (swing sections) S1 to S7. The scanning areas S1 to S7 are virtual sections set in advance on the polishing surface 43*a* and arranged in the swing direction of the dresser 51 (that is, in the radial direction of the polishing pad 43). The dresser 51 dresses the polishing pad 43 while moving so that the center thereof crosses the scanning areas S1 to S7. Lengths of the scanning areas S1 to S7 may be the same or different from each other.

Figure 5:
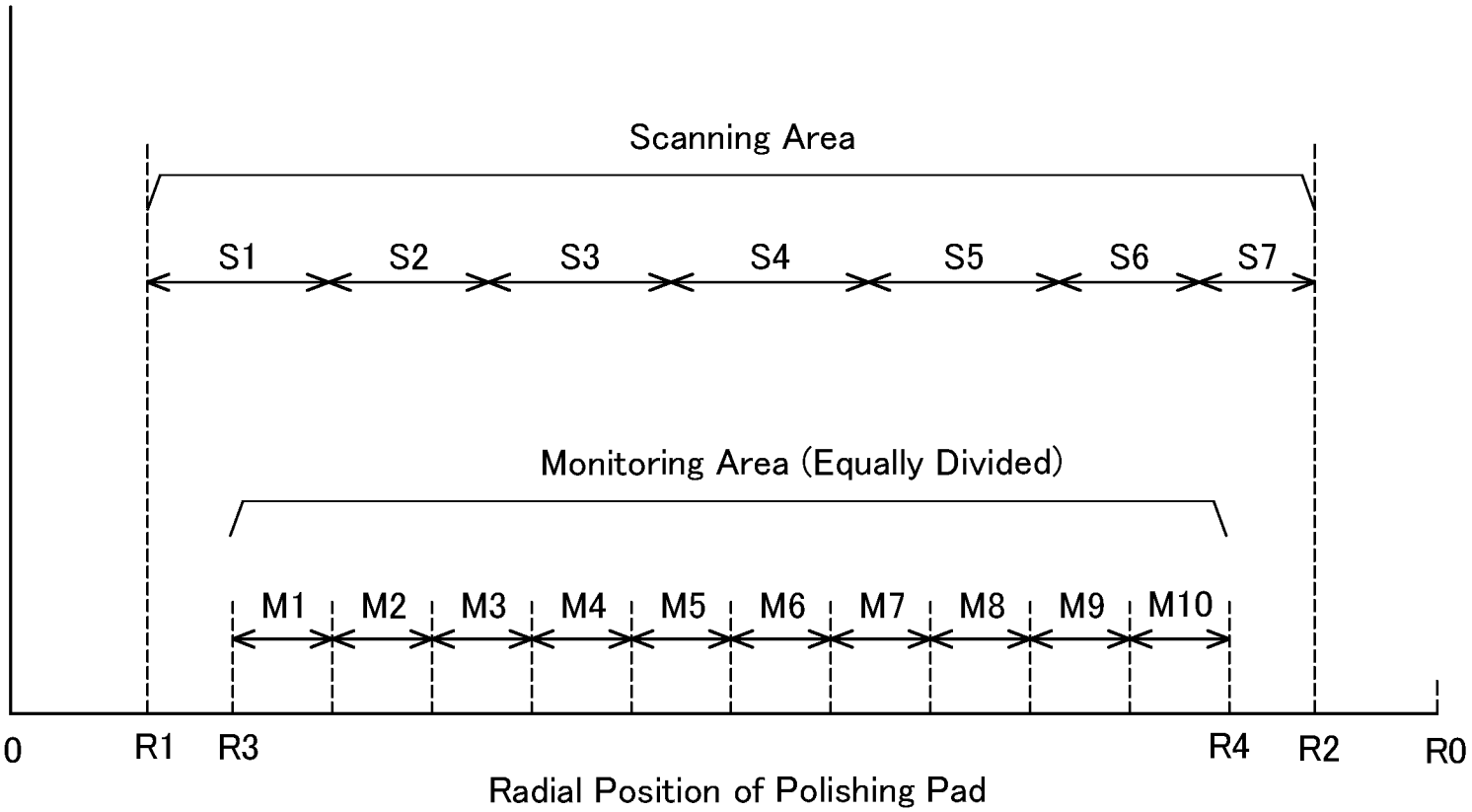
FIG. 5 is an explanatory diagram illustrating a relationship between a scanning area and a monitoring area of the polishing pad.

FIG. 5 is an explanatory diagram illustrating a positional relationship between the scanning areas S1 to S7 and monitoring areas M1 to M10 of the polishing pad 43, and the horizontal axis in FIG. 5 represents a distance from the center of the polishing pad 43. A case has been described in the present embodiment where seven scanning areas and ten monitoring areas are set as an example, but these numbers can be changed as appropriate. Since it is difficult to control a pad profile in a region having a width corresponding to the radius of the dresser 51 from both ends of the scanning area, monitoring exclusion ranges are provided inside (regions R1 to R3 from the center of the pad) and outside (regions R4 to R2 from the center of the pad), but the monitoring exclusion ranges need not always be provided.

The moving speed of the dresser 51 when swinging on the polishing pad 43 is set in advance for each of the scanning areas S1 to S7 and can be adjusted as appropriate. A moving speed distribution of the dresser 51 represents moving speeds of the dresser 51 in the respective scanning areas S1 to S7.

The moving speed of the dresser 51 is one of determinants of a pad height profile of the polishing pad 43. A cutting rate of the polishing pad 43 represents an amount (thickness) of the polishing pad 43 shaved by the dresser 51 per unit time. When the dresser is moved at a constant speed, a thickness of the polishing pad 43 shaved in each scanning area normally differs from one scanning area to another, and so a numerical value of the cutting rate also differs from one scanning area to another. However, since it is normally preferable that the pad profile maintain an initial shape, the moving speed is adjusted so that a difference in a shaving amount per scanning area becomes small.

Here, increasing the moving speed of the dresser 51 means shortening a staying time of the dresser 51 on the polishing pad 43, that is, reducing an amount of shaving of the polishing pad 43. On the other hand, decreasing the moving speed of the dresser 51 means extending a staying time of the dresser 51 on the polishing pad 43, that is, increasing an amount of shaving of the polishing pad 43. Therefore, by increasing the moving speed of the dresser 51 in a certain scanning area, the amount of shaving in the scanning area can be reduced or by decreasing the moving speed of the dresser 51 in a certain scanning area, the amount of shaving in the scanning area can be increased. This makes it possible to adjust the pad height profile of the entire polishing pad.

The dresser controller 60 is a general-purpose or dedicated computer apparatus in which a control program is installed for executing a dressing process on the polishing pad 43 and a control process on a polishing pad profile, which will be described later. The control program may be installed in advance in a computer that constitutes the dresser controller 60 or may be stored in a storage medium such as a CD-ROM or DVD-ROM or further may be installed in the apparatus controller 15 via the Internet. The dresser controller 60 may be provided in the substrate processing apparatus 10 or may be connected to the substrate processing apparatus 10 via a network.

Figure 6:
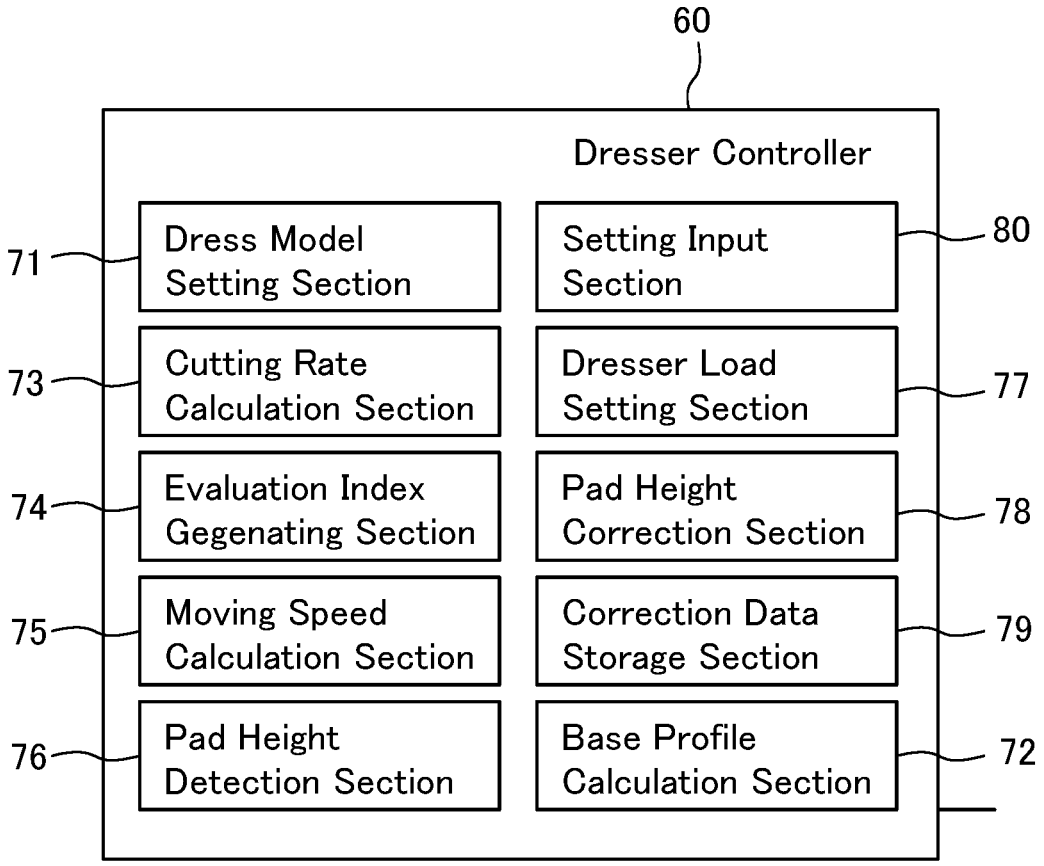
FIG. 6 is a block diagram illustrating an example of a functional block configuration of a dresser controller.

As shown in FIG. 6, the dresser controller 60 is provided with a dress model setting section 71, a base profile calculation section 72, a cutting rate calculation section 73, an evaluation index creation section 74, a moving speed calculation section 75, a pad height detection section 76, a dresser load setting section 77, a pad height correction section 78, a correction data storage section 79 and a setting input section 80, and acquires a profile of the polishing pad 43 and sets at predetermined timing, the moving speed of the dresser 51 to be optimal in a scanning area.

The dress model setting section 71 sets a dress model S to calculate an amount of wear of the polishing pad 43 in the scanning area. The dress model S is a real number matrix with m rows and n columns when the number of partitions in the monitoring area is m (10 in the present embodiment) and the number of partitions in the scanning area is n (7 in the present embodiment), which is determined by various parameters, which will be described later.

When a scanning speed of the dresser in each scanning area set by the polishing pad 43 is $V=[v_1, v_2, \ldots, v_n]$ and a width of each scanning area is $W=[w_1, w_2, \ldots w_n]$, a staying time of (center of) the dresser in each scanning area is represented by:

$$T=W/V=[w_1/v_1, w_2/v_2, \ldots w_n/v_n]$$

At this time, when an amount of wear of the pad in each monitoring area is $U=[u_1, u_2, \ldots, u_m]$, an amount of wear of the pad U is calculated by performing a matrix operation using the aforementioned dress model S and a staying time T in each scanning area:

$$U=ST$$

When deriving the dress model matrix 5, it is possible to take into consideration and appropriately combine such elements as 1) a cutting rate model, 2) a dresser diameter and 3) scanning speed control. The cutting rate model is set on the assumption that each element of the dress model matrix S is proportional to the staying time in a monitoring area or proportional to a scratching distance (moving distance).

Regarding the dresser diameter, each element of the dress model matrix S is set on the assumption of taking into consideration the diameter of the dresser 51 (the polishing pad is worn according to a cutting rate identical over the entire effective area of the dresser) or not taking into consideration the diameter of the dresser 51 (according to the cutting rate only at the center position of the dresser 51). With the dresser diameter taken into consideration, it is possible to define an appropriate dress model even for such a dresser with diamond particles applied in a ring shape. Regarding the scanning speed control, each element of the dress model matrix S is set depending on whether a change in the moving speed of the dresser is stepped or sloped. By combining these parameters as appropriate, it is possible to calculate an amount of cutting more conforming to the actual condition from the dress model S and calculate a correct profile expected value.

The pad height detection section 76 detects a pad height in each monitoring area by associating height data of the polishing pad 43 continuously measured by the pad height sensor 58 with the measured coordinate data on the polishing pad. Correction of a profile (pad height profile) at a pad height corresponding to the dresser load will be described later.

Figure 7:
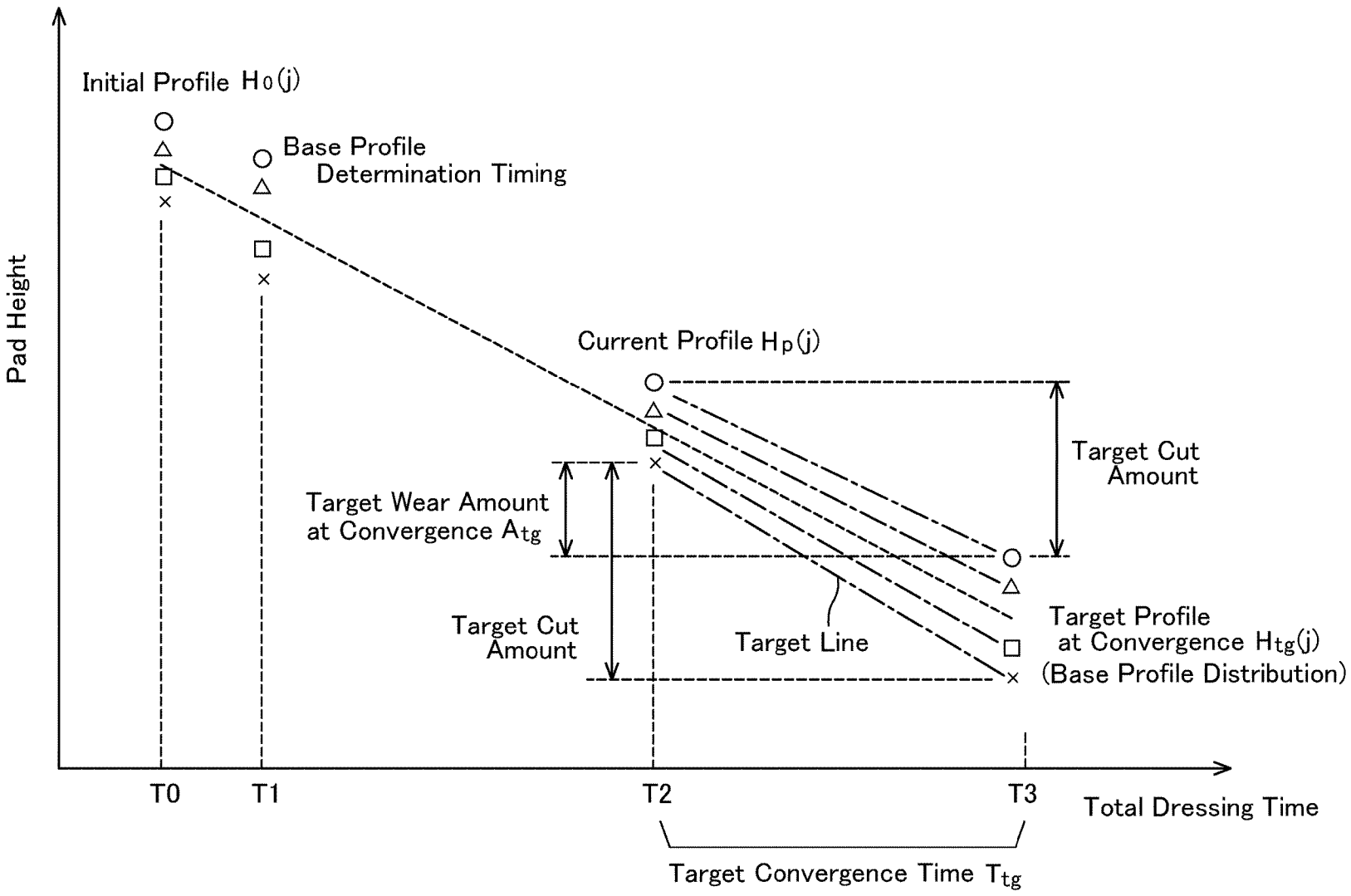
FIG. 7 is an explanatory diagram illustrating an example of profile transition of polishing pad height in each scanning area.

At predetermined timing or at a time when a predetermined condition is established (T1), the base profile calculation section 72 calculates a target profile (base profile $H_{tg}(j)$) of the pad height at convergence (see FIG. 7). The base profile is used to calculate a target amount of cutting used by the moving speed calculation section 75, which will be described later. The base profile may be calculated based on a height distribution (Diff(j)) of the polishing pad in a pad initial state and the measured pad height, or may also be given as a set value. When the base profile is not set, the target amount of cutting at which the shape of the polishing pad 43 becomes flat may be calculated.

A base of the target amount of cutting is calculated according to the following expression using a pad height profile $H_p(j)[j=1, 2, \ldots, m]$ indicating a pad height for each monitoring area at the current time (T2) and a separately set target amount of wear $A_{tg}$ at convergence.

$$\min\{H_p(j)\}-A_{tg}$$

A target amount of cutting of each monitoring area may be calculated according to the following expression by taking into account the aforementioned base profile:

$$\min\{H_p(j)\}-A_{tg}+\mathrm{Diff}(j)$$

The cutting rate calculation section 73 calculates a cutting rate of the dresser in each monitoring area. For example, the cutting rate may be calculated from a gradient of the amount of change in the pad height in each monitoring area.

The evaluation index creation section 74 optimizes the moving speed of the dresser in each scanning area by calculating and correcting an optimum staying time (swing time) in the scanning area using an evaluation index, which will be described later. The evaluation index is an index based on 1) a deviation from the target amount of cutting, 2) a deviation from the staying time with a reference recipe and 3) a speed difference between adjacent scanning areas, and which is a function of the staying time $T=[w_1/v_1, w_2/v_2, \ldots, w_n/v_n]$ in each scanning area. The moving speed of the dresser is optimized by determining the staying time T in each scanning area to minimize the evaluation index.

1) Deviation from Target Amount of Cutting

When the target amount of cutting of the dresser is $U_0=[U_{01}, U_{02}, \ldots, U_{0m}]$, the deviation from the target amount of cutting is calculated by calculating the square value ($|U-U_0|^2$) of a difference from the amount of wear of the pad U(=ST) in each of the aforementioned monitoring areas. Note that the target profile for determining the target amount of cutting can be determined at any timing after starting to use the polishing pad or based on a manually set value.

2) Deviation from Staying Time with Reference Recipe

Figure 8:
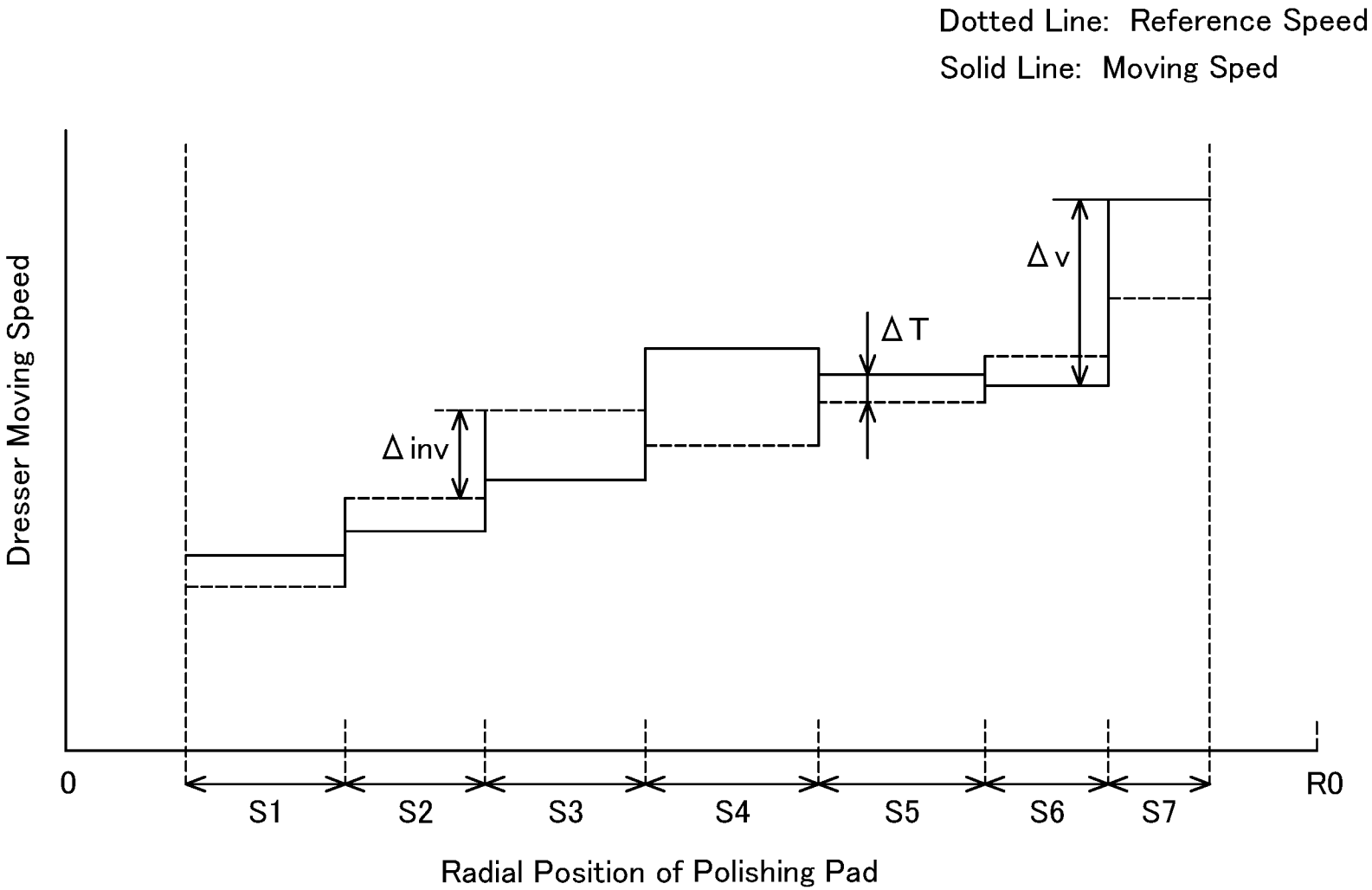
FIG. 8 is an explanatory diagram illustrating an example of a dresser moving speed and a reference value in each scanning area.

As shown in FIG. 8, a deviation from the staying time with a reference recipe can be calculated by finding the square value ($\Delta T^2=|T-T_0|^2$) of a difference ($\Delta T$) between the moving speed (reference speed (reference staying time $T_0$)) of the dresser based on the reference recipe set in each scanning area and the moving speed (staying time T of the dresser) of the dresser in each scanning area. Here, the reference speed is a moving speed at which a flat cutting rate is expected to be obtained in each scanning area, and is a value obtained by an experiment or simulation in advance. When the reference speed is obtained by simulation, it can be obtained, for example, assuming that a scratching distance (staying time) of the dresser is proportional to an amount of cutting of the polishing pad. Note that the reference speed may be updated as appropriate according to the actual cutting rate when the same polishing pad is used.

3) Speed Difference Between Adjacent Scanning Areas

The polishing apparatus according to the present embodiment suppresses influences of a drastic change in the moving speed on the polishing apparatus by suppressing a speed difference between the adjacent scanning areas. That is, by obtaining the square value ($|\Delta V_{inv}|^2$) of a speed difference between the adjacent scanning areas, it is possible to calculate an index of the speed difference between the adjacent scanning areas. Here, as shown in FIG. 8, either a difference in the reference speed ($\Delta_{inv}$) or a moving speed ($\Delta_v$) of the dresser can be applied as the speed difference between the scanning areas. Note that since the width of the scanning area is a fixed value, the index of the speed difference depends on the staying time of the dresser in each scanning area.

The evaluation index creation section 74 defines an evaluation index J expressed in the following expression based on the three indices:

$$J=\gamma|U-U_0|^2+\lambda|T-T_0|^2+\eta|\Delta V_{inv}|^2$$

Here, a first term, a second term and a third term of the right side of the evaluation index J are indices resulting from a deviation from a target amount of cutting, a deviation from a staying time with a reference recipe and a speed difference between adjacent scanning areas respectively, and all such terms depend on the staying time T of the dresser in each scanning area.

The moving speed calculation section 75 performs optimization operation so that the value of the evaluation index J takes a minimum value, obtains the staying time T of the dresser in each scanning area and corrects the moving speed of the dresser. As a technique for optimization operation, quadratic programming may be used, whereas convergence operation by simulation or PID control may also be used.

In the above-described evaluation index J, $\gamma$, $\lambda$ and $\eta$ are predetermined weighted values, and can be changed as appropriate while the same polishing pad is used. By changing these weighted values, it is possible to adjust indices to be emphasized according to characteristics of the polishing pad or the dresser and an operating situation of the apparatus as appropriate.

Note that when obtaining the moving speed of the dresser, the total dress time is preferably set within a predetermined value. The total dress time here is a moving time in all the swing sections (scanning areas S1 to S7 in the present embodiment) by the dresser. When the total dress time (time required for dressing) extends, this may affect other processes such as a polishing process of the substrate and a transport process, and so it is preferable to correct the moving speed in each scanning area as appropriate so that this value does not exceed the predetermined value. Furthermore, since there are mechanical constraints on the apparatus, it is preferable to set the moving speed of the dresser so that a maximum (and minimum) moving speed of the dresser and a ratio of the maximum speed (minimum speed) to an initial speed also fall within set values.

Note that when an appropriate dress condition is unknown for a combination of a new dresser and the polishing pad or when no reference speed (reference staying time $T_0$) is determined for the dresser immediately after replacement of the dresser or the polishing pad, the moving speed calculation section 75 may determine an evaluation index J (which will be described below) using only the condition of a deviation from a target amount of cutting and optimize the moving speed of the dresser in each scanning area (initial setting).

$$J=|U-U_0|^2$$

The dresser load setting section 77 sets a load applied to the polishing surface 43*a* of the polishing pad 43 from the dresser 51 (dresser load), changes the position of the air cylinder 54 and adjusts the dresser load on the polishing pad 43. When the dresser load is changed from the reference value (reference dresser load), the amount of pushing by the dresser 51 against the polishing pad 43 changes. For example, when the dresser load increases, the polishing pad 43 is further pushed, and so the pad height is reduced. On the contrary, when the dresser load decreases, the pad height of the polishing pad 43 increases. As a result, the position of the polishing surface 43*a* fluctuates, and so it is not possible to calculate the height (amount of wear) of the polishing pad 43.

To cancel change in the pad height caused by a change in the dresser load, the pad height correction section 78 calculates a correction value of the pad height corresponding to the amount of change in the dresser load. Since the amount of change in the pad height can vary depending on the position of the polishing pad 43 in the radial direction, the pad height correction section 78 is configured to calculate a plurality of correction values of pad height according to the position of the polishing pad 43 in the radial direction.

Figure 9:
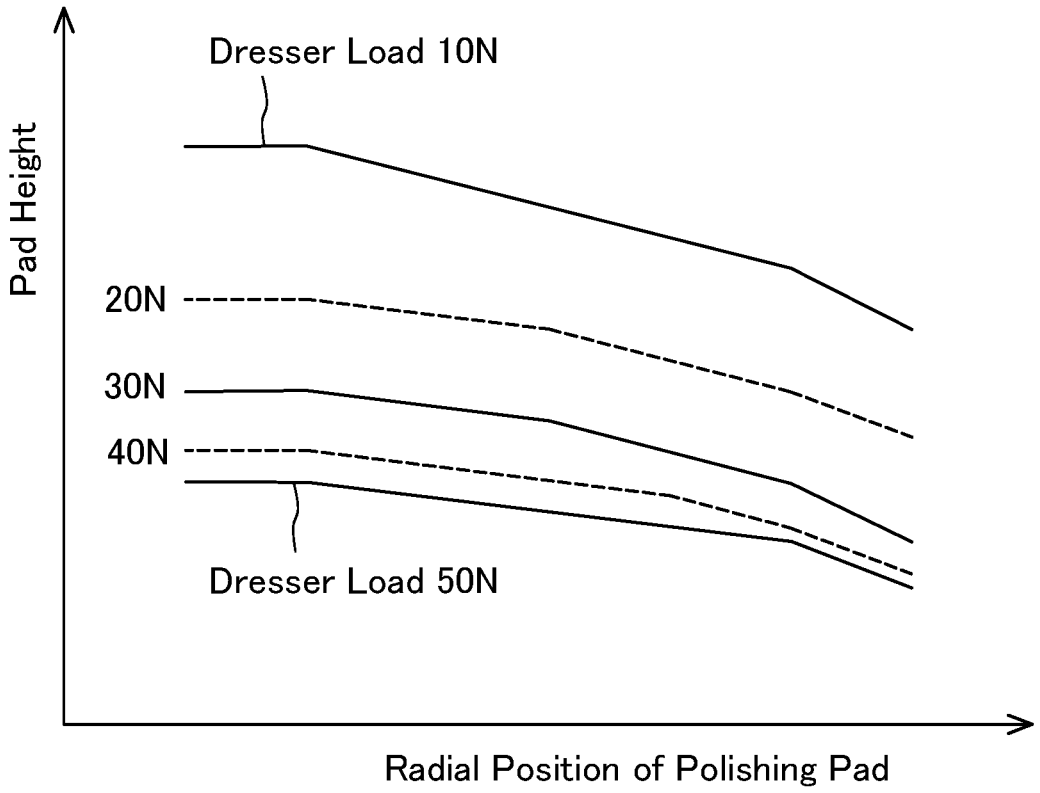
FIG. 9 is a graph illustrating an example of a relationship between a polishing pad radius position and a pad height when a dresser load is changed.

FIG. 9 is a graph illustrating an example of polishing pad height distribution when the dresser load is changed, the horizontal axis represents a position of the polishing pad in the radial direction and a point where the polishing pad height distribution crosses the vertical axis shows that the radius position is zero (center of the polishing pad). The pad height represents a relative height from a predetermined reference value and indicates that the greater the pad height value is, the higher the polishing surface 43*a* of the polishing pad 43 is. The graph in FIG. 9 indicates that the greater the dresser load is, the lower the pad height is, and the greater (the closer to the outer circumference of the polishing pad 43) the radius position is, the lower the pad height is. The pad height data is measured in advance for each dresser load by testing at a plurality of radius positions (7 points in increments of 50 mm from a position of 50 mm from the center of the polishing pad to a position of 350 mm in the example in FIG. 9) and stored in the correction data storage section 79 as pad height reference data by load/radius.

The pad height reference data by load/radius may be measured statically (with the polishing table 44 and the dresser 51 stopped) or dynamically (in a state close to actual dressing of the polishing pad 43 by turning the polishing table 44 and the dresser 51, and further swinging the dresser 51). Dynamical measurement is desirable because it is possible to acquire data continuously at a plurality of radius positions. The loads and the radius positions are not limited to the above-described example, but may be changed as appropriate if there is a situation close to a range of actual use. However, it is preferable that there be three or more loads and radius positions respectively.

The pad height correction section 78 can calculate a pad height correction amount, for example, as follows: When the dresser load set by the dresser load setting section 77 is $DF_x$, the pad height correction section 78 reads two dresser loads ($DF_1$, $DF_2$) close to the $DF_x$ and the pad height reference data ($PadH_1$, $PadH_2$) corresponding to the dresser load from the pad height reference data by load/radius stored in the correction data storage section 79, and interpolates and calculates pad height $PadH_x$ corresponding to the set dresser load $DF_x$ according to the following formula.

$$PadH_x=(PadH_1-PadH_2)/(DF_1-DF_2)\times(DF_x-DF_2)+PadH_2$$

where, $DF_1<DF_x<DF_2$

Note that as the interpolation formula, interpolation may be performed using, for example, a spline in addition to the linear interpolation according to the above-described formula.

As shown, for example, in FIG. 9, about a dresser load for every 10 N, pad height reference data by load/radius is stored in the correction data storage section 79, and if $DF_x$ is set to 15 N, $DF_1$ is 10 N and $DF_2$ is 20 N. Thus, pad height reference data corresponding to the dresser loads 10 N and 20 N is read from the correction data storage section 79 and a pad height $H_x$ is calculated for each radius position of the polishing pad. The pad height correction section 78 calculates the pad height $PadH_x$ calculated according to the above-described formula for each of a predetermined reference load and a dresser load (measured load) used for actual dressing for every radius position of the polishing pad. The calculated pad height $PadH_x$ value is stored in the correction data storage section 79.

Figure 10:
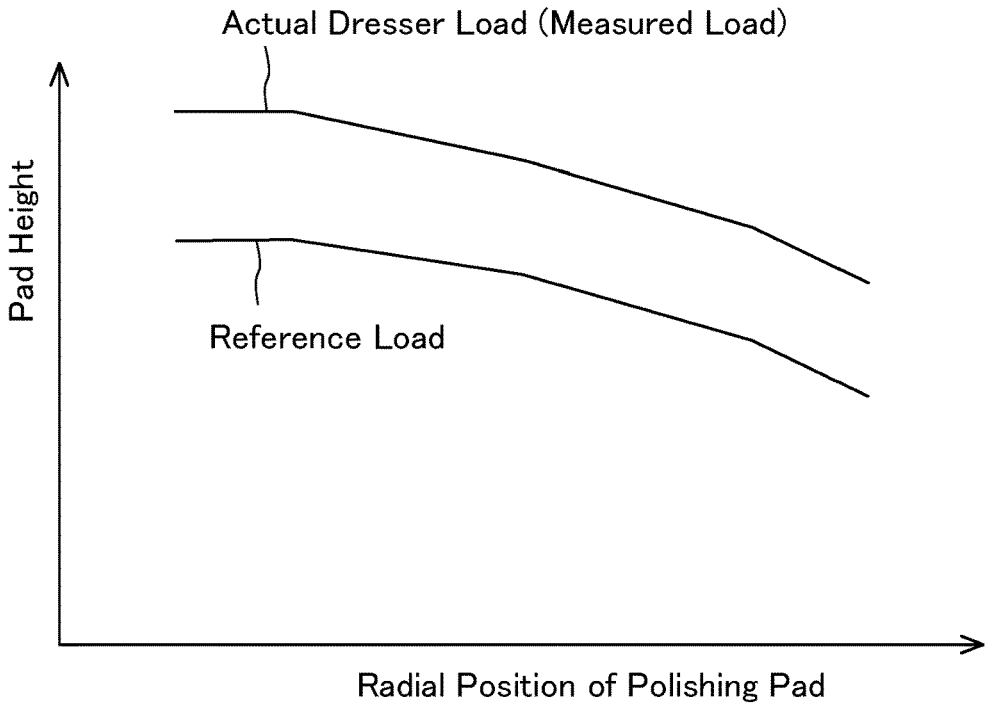
FIG. 10 is a graph illustrating an example of a relationship between a polishing pad radius position and a pad height when a set value (measured load) of a dresser load is changed from a reference load.

A graph in FIG. 10 shows pad height values calculated by interpolation and arranged along the radius positions of the polishing pad, indicating a pad height $PadH_{bBF}$ with a reference load (e.g., 25 N) and a pad height $PadH_{mDF}$ with a measured load (e.g., 15 N). Since the reference load here is often constant regardless of the measured load, the reference load may be calculated in advance and then stored in the correction data storage section 79. This makes it possible to shorten a pad height correction process.

The pad height correction section 78 calculates an amount of correction $PadH_{delta}(r)$ for converting the pad height $PadH_{mDF}(r)$ by the measured load to a reference load $PadH_{bBF}(r)$ for each radius position of the polishing pad according to the following expression:

$$PadH_{delta}(r)=PadH_{mDF}(r)-PadH_{bDF}(r)$$

Next, the pad height correction section 78 applies an interpolation process according to the value of a correction amount obtained for each radius position and thereby generates a function F(DF, r) of the correction amount with respect to the radius position of the polishing pad.

Figure 11:
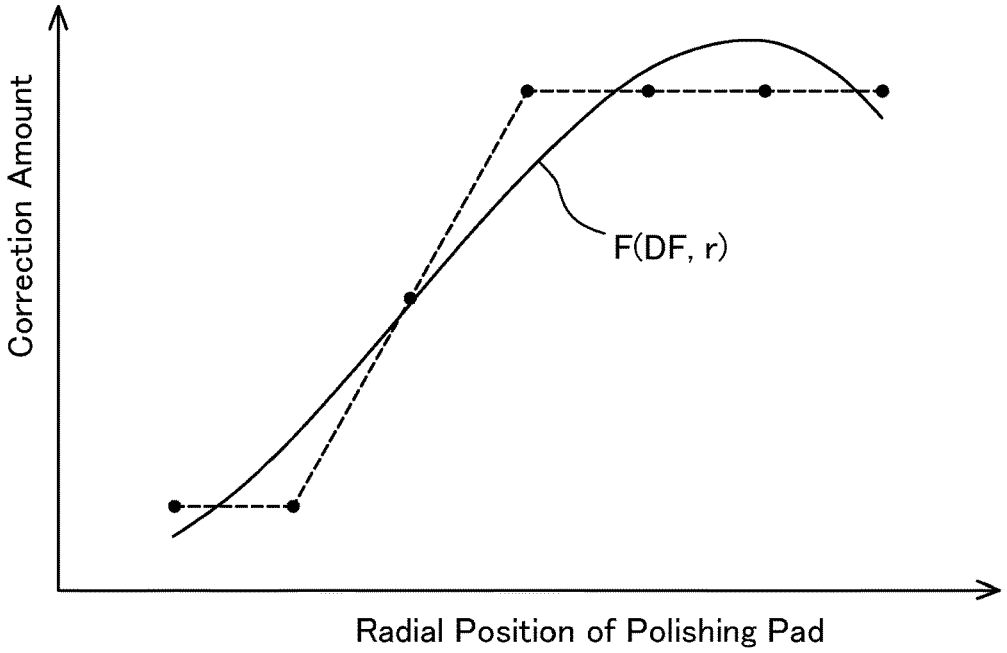
FIG. 11 is a graph illustrating an example of a pad height correction amount with respect to a polishing pad radius position.

FIG. 11 is a graph illustrating an example of the function F(DF, r) of the correction amount, each point represents a discrete value of the correction amount $PadH_{delta}(r)$ calculated according to the above-described expression (e.g., 7 points in increments of 50 mm from a position 50 mm from the center of the polishing pad up to 350 mm), a curve represents an example of the function F obtained by spline interpolation based on the discrete values, a straight line represents an example of the function F obtained by linear interpolation from the adjacent discrete values. In obtaining the function F, an appropriate interpolation formula can be used, but when there is a large difference between adjacent discrete values, it is preferable to obtain the function F by linear interpolation.

Calculation expressions for pad height measured data and correction values are preferably created according to the type (hardness) of the polishing pad used for dressing or may be created for every combination of a polishing pad and a dresser. Furthermore, pad height measured data and a correction value calculation expression specific to the polishing table may be defined.

The pad height correction section 78 calculates a pad height to be used for pad control (pad height redrawn for the reference load) PadH(r) from the polishing pad height (measured height) $PadH_{measure}(r)$ measured at a certain radius position using the function F(DF, r) obtained above.

$$PadH(r)=PadH_{measure}(r)+PadH_{delta}(r)$$

The setting input section 80 is an input device such as a keyboard or a mouse and inputs various types of parameters such as a value of each component of the dress model matrix S, a setting of constraint condition, cutting rate update cycle and moving speed update cycle. Data of a program to operate each component constituting the dresser controller 60, a value of each component of the dress model matrix S, a target profile, a weighted value of an evaluation index J, various data such as a set value of the moving speed of the dresser are stored in a memory (not shown) provided in the dresser controller 60.

Figure 12:
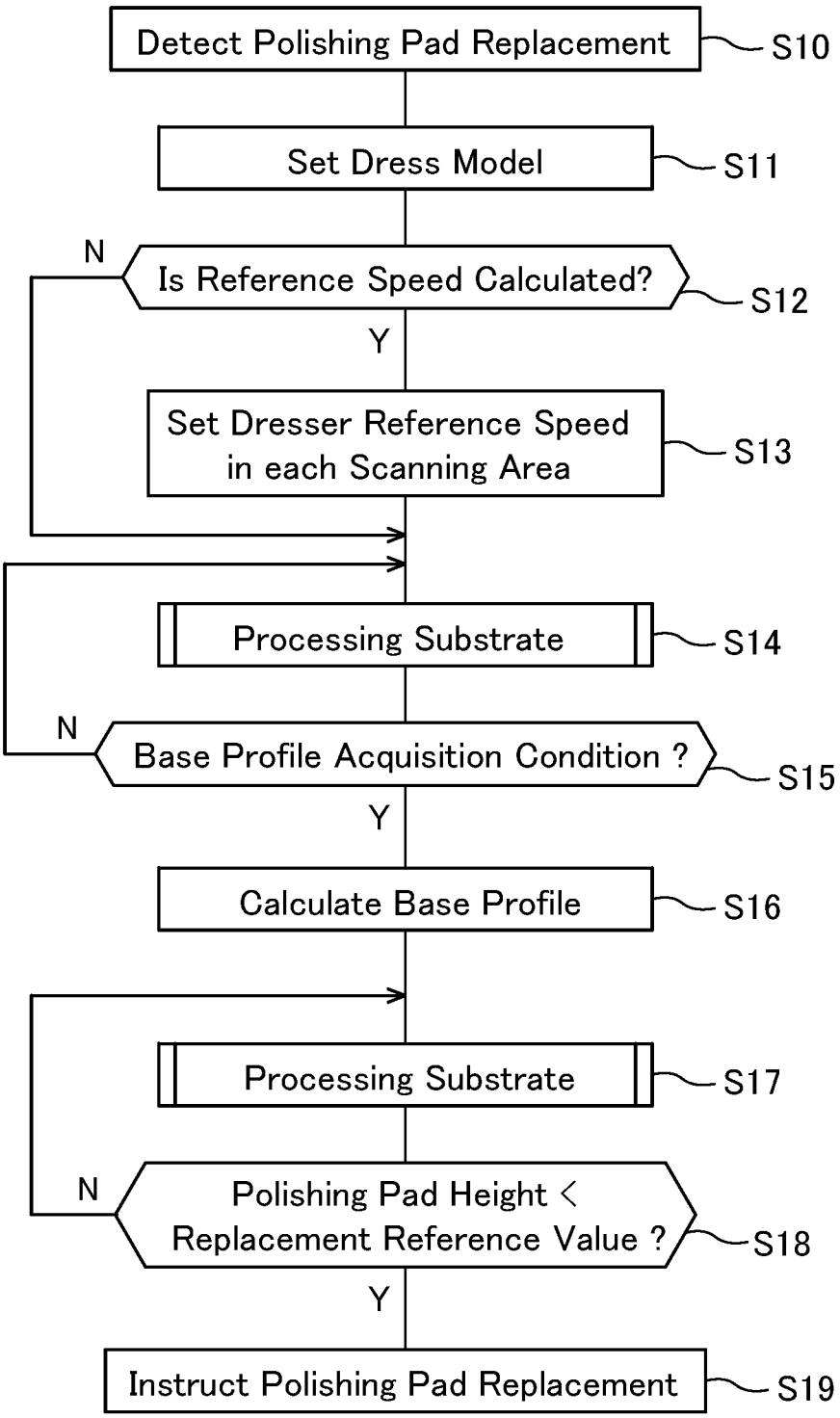
FIG. 12 is a flowchart illustrating an example of operation of the substrate processing apparatus on one polishing pad.

FIG. 12 is a flowchart illustrating a procedure for controlling the moving speed of the dresser while performing polishing and a cleaning process on a plurality of substrates W after replacement of a polishing pad. When the apparatus controller 15 detects that the polishing pad 43 has been replaced due to a reset process of a pad operating time or the like (step S10), the dress model setting section 71 derives the dress model matrix S by taking into account the parameters such as a cutting rate model, a dresser diameter and scanning speed control (step S11). Note that if the polishing pads 43 before and after replacement are of the same type, the same dress model matrix can also be used continuously.

It is then determined whether or not to calculate the reference speed of the dresser (e.g., whether or not the setting input section 80 has made an input that the reference speed is calculated) (step S12). When the reference speed is calculated, the moving speed calculation section 45 sets a moving speed of the dresser (staying time T) in each scanning area from a target amount of cutting $U_0$ of the dresser and an amount of wear of the pad U in each monitoring area so that the next evaluation index J becomes a minimum value (step S13). The calculated reference speed may be set as an initial value of the moving speed.

$$J=|U-U_0|^2$$

After that, when the substrate W is set, the substrate W is polished and cleaned (step S14), and if a predetermined condition is satisfied, a base profile is calculated. When another condition is satisfied, the cutting rate is calculated or the dresser moving speed is updated (see FIG. 13). An instruction for pad replacement may be determined by the number of processed substrates W or automatically determined by the height of the polishing pad.

Figure 13:
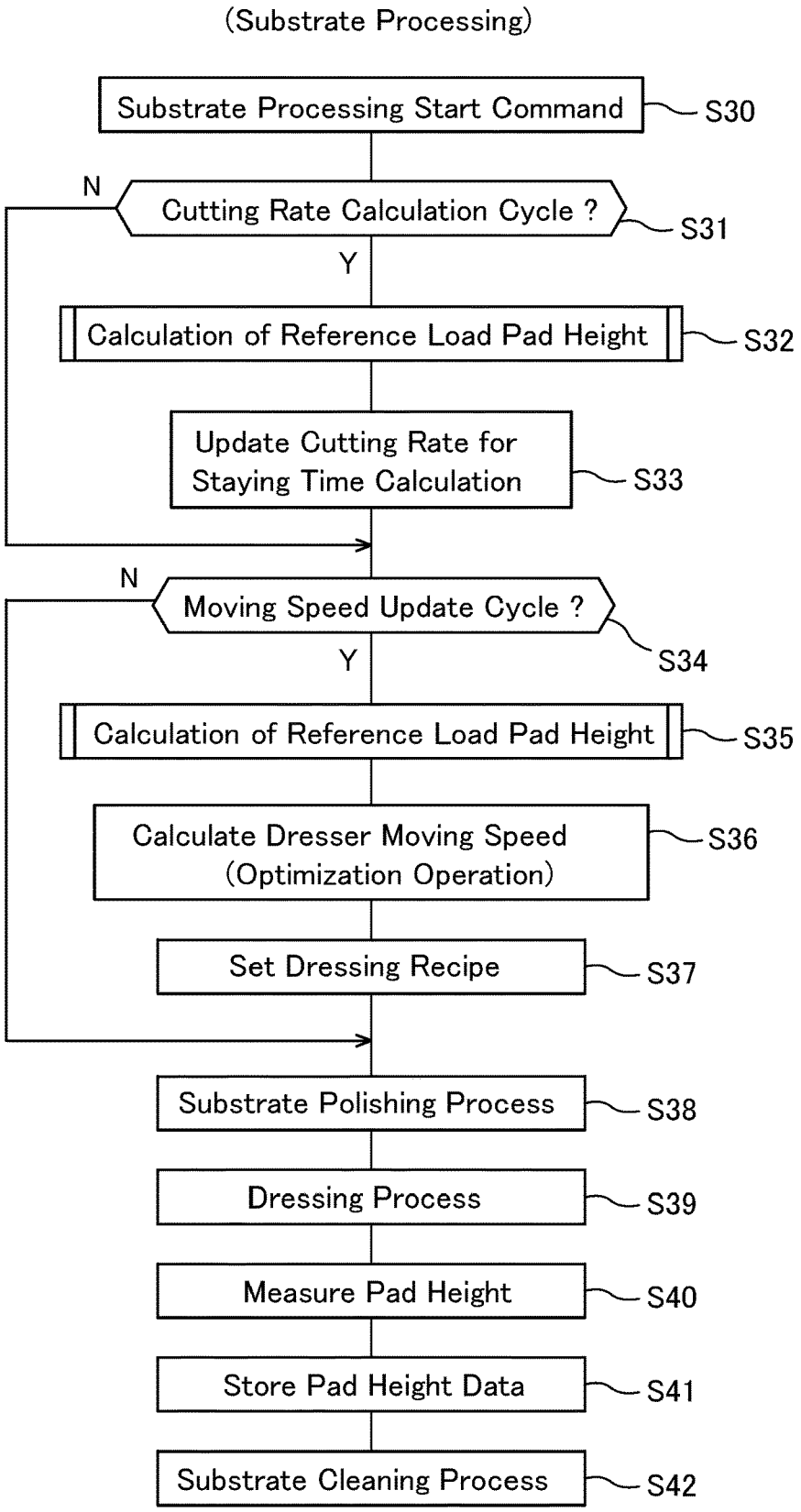
FIG. 13 is a flowchart illustrating an example of a substrate processing process.

FIG. 13 is a flowchart illustrating a procedure for processing the substrate W, and when the apparatus controller 15 issues a substrate processing start command (step S30), the dresser controller 60 determines whether or not a predetermined condition has been satisfied (in an example in FIG. 13, the dresser controller 60 determines whether or not the cutting rate calculation cycle (e.g., polishing of a predetermined number of substrates W) is reached) (step S31). When the predetermined number of substrates W is reached, a reference load pad height, which will be described later, is calculated (step 32), and further the cutting rate calculation section 73 calculates and updates a cutting rate of the dresser in each scanning area (step S33). On the other hand, when the condition is not satisfied, the cutting rate update process is skipped.

Furthermore, the dresser controller 60 determines whether or not a predetermined condition is satisfied (in the example in FIG. 13, the dresser controller 60 determines whether or not the moving speed update cycle (e.g., polishing of a predetermined number of substrates W) has been reached) (step S34). When the moving speed update cycle has been reached, the dresser controller 60 calculates the reference load pad height (step 35), the moving speed setting section 75 calculates the staying time of the dresser during which the evaluation index J becomes a minimum and thereby optimizes the dresser moving speed in each scanning area (step S36). The optimized moving speed value is set and the dresser moving speed (dressing recipe) is updated (step S37).

Figure 14:
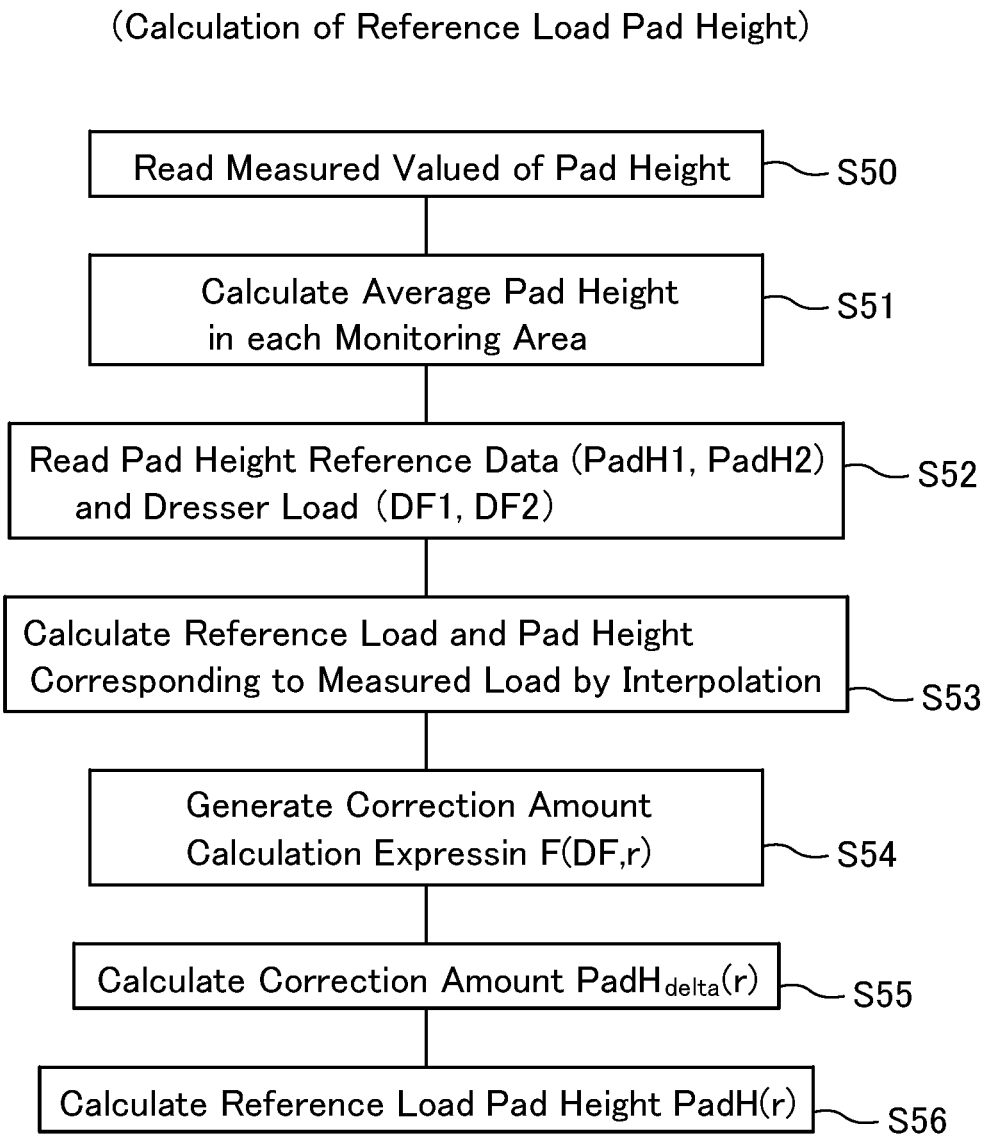
FIG. 14 is a flowchart illustrating an example of a reference load pad height calculation process.

FIG. 14 is a flowchart illustrating a calculation process of a reference load pad height in step S35 (and step S32), and the pad height correction section 78 reads data of the measured value of the pad height stored in the correction data storage section 79 (step S50). Next, the pad height correction section 78 takes an average value of measurements at the corresponding radius positions for every monitor region of the polishing pad, thereby calculates an average pad height in each monitor region (step S51) and takes it as a measured value $PadH_{measure}(r)$ of the pad height (step S51). Alternatively, instead of calculating the average value in each monitor region, a measured value at each radius position may be taken as $PadH_{measure}(r)$.

Next, the pad height correction section 78 reads the two dresser loads ($DF_1$, $DF_2$) close to the dresser load (measured load) $DF_x$ set by the dresser load setting section 77 and the pad height reference data ($PadH_1$, $PadH_2$) corresponding to the dresser load (step S52). Similarly, the pad height correction section 78 reads the two dresser loads close to the reference load and the corresponding pad height reference data.

The pad height correction section 78 calculates a reference load and a pad height corresponding to the measured load from the read dresser load and pad height reference data by interpolation for every radius position of the polishing pad (step S53). The pad height correction section 78 generates a pad height correction amount calculation expression F(DF, r) corresponding to the measured load from the pad height information obtained by interpolation (step S54).

Next, the pad height correction section 78 calculates an amount of correction $PadH_{delta}(r)$ corresponding to the radius position of the pad height measured value $PadH_{measure}(r)$ from the obtained calculation expression F(DF, r) (step S55), and calculates a reference load pad height PadH(r) from the correction amount (step S56).

In FIG. 13, when the reference load pad height PadH(r) is calculated and the calculations is completed according to the calculation conditions, a polishing process on the substrate W set in the substrate polishing unit is performed (step S38). Polishing of the substrate W may be enabled to continue until a predetermined film thickness is obtained or until a base layer is exposed. When the substrate W for which polishing has finished is taken out from the substrate polishing unit, the dresser controller 60 drives the dresser 51 according to the set dressing recipe and performs a dressing process on the polishing pad 43 (step S39). When the dressing process on the polishing pad 43 is performed, the pad height sensor 58 measures the height (pad height) of the polishing surface 43*a* (step S40), and the measured data is saved in a memory in the dresser controller 60 (step S41). The polished substrate W is sent to the cleaning section 14 (the first substrate cleaning apparatus 30, the second substrate cleaning apparatus 31, the substrate drying apparatus 32), subjected to substrate cleaning and drying (step S42), and taken out of the substrate processing apparatus 10.

In FIG. 12, when a substrate process 14 is finished, it is determined whether or not the base profile acquisition conditions (e.g., polishing of a predetermined number of substrates W) have been satisfied (step S15) and if the conditions have been satisfied, the base profile calculation section 72 calculates a target profile (base profile) of the pad height at convergence (step S16). When the acquisition conditions of the base profile are not satisfied (when the predetermined number of substrates W have not been polished), the flow is returned to step S14 and polishing and cleaning processes on the next substrate W are performed.

When the base profile is set, polishing and cleaning processes on the next substrate W are performed (step S17). The polishing and cleaning processes are similar to those described in the flowchart in FIG. 13, and so detailed description will be omitted. Hereinafter, the substrate process will continue to be performed in step S17 until the amount of shaving of the polishing pad increases and the polishing pad height is below the replacement reference value (step S18). When the polishing pad height is below the replacement reference value ("Y" in step S18), the apparatus controller 15 instructs the operator to replace the polishing pad via the output section 66 (step S19).

Figure 15:
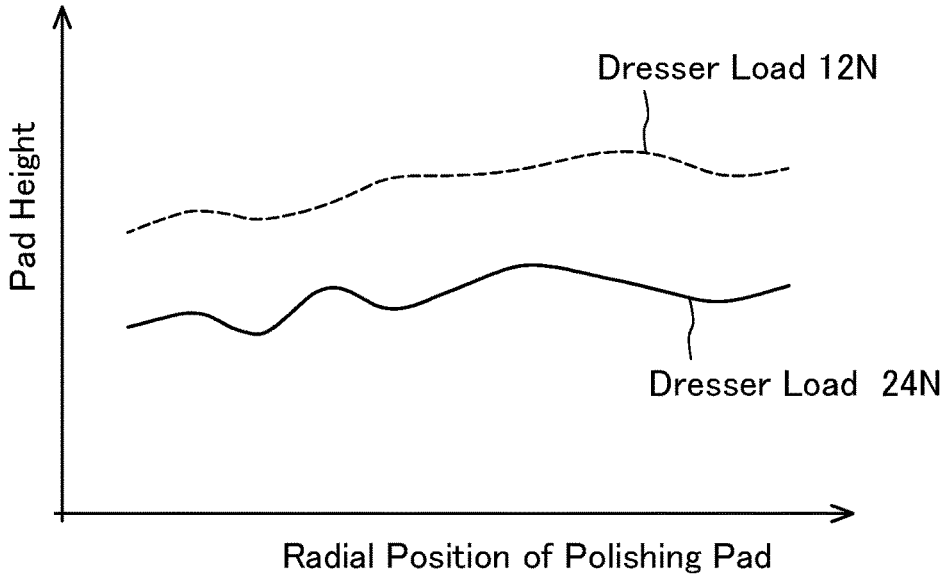
FIG. 15 is a graph illustrating an example of a relationship between a polishing pad radius position and a pad height when the dresser load is changed, in which (a) illustrates a case where no pad height correction is made and (b) illustrates a case where pad height correction is made.
Figure 15:
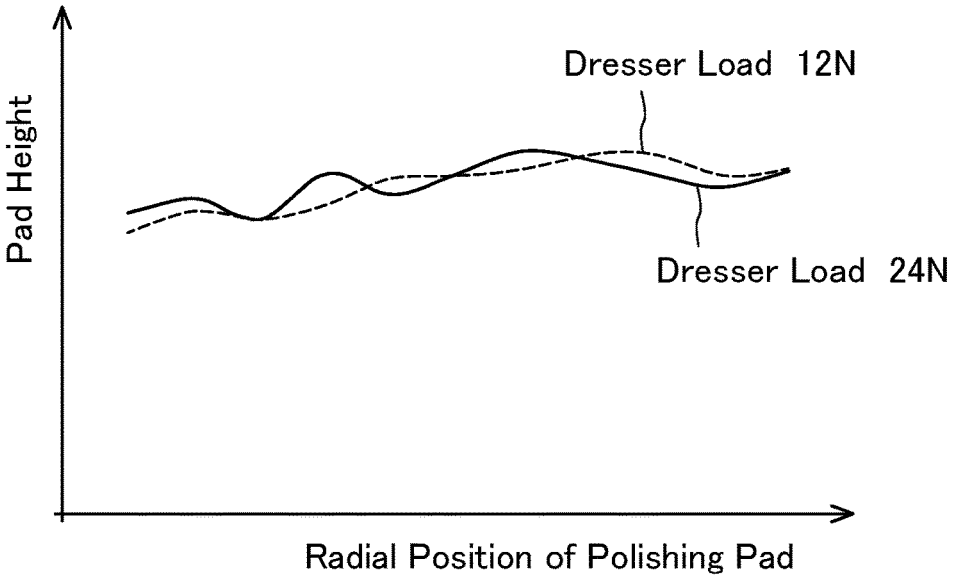

FIG. 15 is a graph illustrating an example of a relationship between a polishing pad radius position and a pad height when the dresser load is changed from 12 N to 24 N. When no pad height correction is made (FIG. 15(*a*)), if the dresser load increases to 24 N, the measured value of the pad height profile decreases (compared to the case with 12 N), and so the moving speed of the dresser cannot be calculated appropriately. On the contrary, when pad height correction is made (FIG. 15(*b*)), even when the dresser load increases, the measured value of the pad height profile is substantially unchanged (compared to the case with 12 N), and so it is possible to calculate the moving speed of the dresser more appropriately.

Since change in thickness of the polishing pad 43 can vary depending on the pad thickness, elastic coefficient (pad stiffness) or cross-sectional area, correction data with respect to a reference load is preferably provided for each type of the polishing pad. Since the polishing pad 43 slightly wears off every time dressing is performed, if dressing is performed more frequently, it may happen that the change in the amount of wear compared to the thickness of the polishing pad immediately after replacement becomes non-negligible.

Thus, when calculating a reference load pad height PadH (r) (step S56), the pad height may be calculated by taking into account an adjustment coefficient f(t) corresponding to a pad operating time (or the amount of wear of the pad). In this case, the reference load pad height PadH(r) can be calculated according to the following expression:

$$\mathrm{Pad}H(r)=\mathrm{Pad}H_{measure}(r)+f(t)\times\mathrm{Pad}H_{delta}(r)$$

Here, the adjustment coefficient f(t) can be determined in advance by testing. Although the adjustment coefficient is assumed to be a function depending on an operating time t of the polishing pad here, it is possible to adopt a configuration in which the number of times dresser processing on the polishing pad is performed is defined as an argument.

The above-described embodiment has been described with the intention to allow a person ordinarily skilled in the art to which the present invention belongs to implement the present invention. Various modifications of the above-described embodiment can be naturally implemented by those skilled in the art and the technical thought of the present invention is also applicable to other embodiments. The present invention is not limited to the described embodiment, but should be interpreted within a broadest possible scope according to the technical thought defined in the scope of the claims.

What is claimed is:

1. A substrate processing apparatus that polishes a substrate by sliding the substrate on a polishing member, the substrate processing apparatus comprising:

a dresser that dresses the polishing member by swinging on the polishing member, the dresser being enabled to adjust a swing speed in a plurality of scanning areas set on the polishing member along a radial direction;

a height detection section configured to generate a pad profile by measuring values of a surface height of the polishing member along the radial direction of the polishing member;

a dresser load setting section configured to set a dresser load to be applied by the dresser to the polishing member;

a pad height correction section configured to correct the pad profile by calculating a plurality of amounts of correction of the surface height of the polishing member according to an amount of variation from a reference load of the dresser load at a plurality of positions over the radial direction and correcting the measured values of the surface height with the plurality of amounts of correction at corresponding positions in the radial direction;

a moving speed calculation section configured to adjust the swing speed of the dresser in each of the plurality of scanning areas based on the corrected pad profile; and a correction data storage section that stores a plurality of pieces of pad height reference data along the radial direction of the polishing member in association with a plurality of reference dresser loads, wherein the pad height correction section is configured to calculate the amounts of correction of the surface height by interpolating the amounts of correction with the pad height reference data corresponding to the reference dresser load close to the set dresser load and the pad height reference data corresponding to the reference dresser load close to the reference load, wherein the pad height reference data is provided for any of a plurality of types of the polishing member or for any of a plurality of types of a dressing surface of the dresser, and wherein the pad height correction section is configured to calculate a pad height $PadH_x$ corresponding to a set dresser load $DF_x$ according to a formula:

$$PadH_x=(PadH_1-PadH_2)/(DF_1-DF_2)\times(DF_x-DF_2)+PadH_2$$

wherein $DF_1$ and $DF_2$ are two dresser loads close to the $DF_x$, and $PadH_1$ and $PadH_2$ are pad height reference data corresponding to the dresser loads $DF_1$ and $DF_2$.

2. The substrate processing apparatus according to claim 1, wherein the pad height correction section is configured to revise the amounts of correction of the surface height based on an operating time of the polishing member or a correction coefficient corresponding to a number of times dressing of the dresser is performed.

3. The substrate processing apparatus according to claim 1, wherein the height detection section is configured to measure the surface height of the polishing member in a plurality of monitoring areas set in advance along the radial direction of the polishing member.

4. The substrate processing apparatus according to claim 1, comprising:

a dress model matrix creation section configured to create a dress model matrix defined from a plurality of monitoring areas, dress models, and the plurality of scanning areas; and an evaluation index creation section configured to calculate a height profile predicted value using the dress model and the swing speed or a staying time in each of the plurality of scanning areas and set an evaluation index based on a difference from a target value of the height profile of the polishing member, wherein the moving speed calculation section is configured to calculate the swing speed of the dresser in each of the plurality of scanning areas based on the evaluation index.

5. A method for dressing a polishing member using a substrate polishing apparatus to re-form irregularities on a surface of the polishing member by swinging a dresser on the polishing member, the dresser being enabled to adjust a swing speed in a plurality of scanning areas set on the polishing member along a swing direction, the method comprising:

generating a pad profile by measuring values of a surface height of the polishing member along a radial direction of the polishing member based on input from a pad height sensor;

applying a dresser load by the dresser to the polishing member based on a set dresser load;

correcting the pad profile based on the measured values of the surface height of the dresser with a plurality of amounts of correction at corresponding positions in the radial direction by calculating the plurality of amounts of correction of the surface height of the polishing member according to an amount of variation from a reference load of the dresser load at a plurality of positions over the radial direction; and adjusting the swing speed of the dresser in each of the plurality of scanning areas based on the corrected pad profile while dressing the polishing member, wherein calculating the amounts of correction of the surface height comprises interpolating the amounts of correction with pad height reference data corresponding to a reference dresser load close to the set dresser load and pad height reference data corresponding to a reference dresser load close to the reference load, wherein the pad height reference data is provided for any of a plurality of types of the polishing member or for any of a plurality of types of a dressing surface of the dresser, and wherein a pad height $PadH_x$ corresponding to a set dresser load $DF_x$ is determined according to a formula:

$$PadH_x=(PadH_1-PadH_2)/(DF_1-DF_2)\times(DF_x-DF_2)+PadH_2$$

wherein $DF_1$ and $DF_2$ are two dresser loads close to the $DF_x$, and $PadH_1$ and $PadH_2$ are pad height reference data corresponding to the dresser loads $DF_1$ and $DF_2$.

6. The method for dressing a polishing member of claim 5, wherein the polishing member is a polishing pad and the substrate polishing apparatus is a semiconductor polishing apparatus.

7. A non-transitory computer-readable recording medium for use with a polishing apparatus that swings a dresser on a polishing member for polishing a substrate to dress the polishing member to re-form irregularities on a surface of the polishing member, a swing speed of the dresser being adjustable in a plurality of scanning areas set on the polishing member along a swing direction, the recording medium comprising an executable code that causes a computer of the polishing apparatus to execute:

generating a pad profile by measuring values of a surface height of the polishing member along a radial direction of the polishing member based on input from a pad height sensor;

causing a dresser load to be applied by the dresser to the polishing member by setting the dresser load;

correcting the pad profile based on the measured values of the surface height of the dresser with a plurality of amounts of correction at corresponding positions in the radial direction by calculating the plurality of amounts of correction of the surface height of the polishing member according to an amount of variation from a reference load of the dresser load at a plurality of positions over the radial direction; and adjusting the swing speed of the dresser in each of the plurality of scanning areas based on the corrected pad profile while dressing the polishing member, wherein calculating the amounts of correction of the surface height comprises interpolating the amounts of correction with pad height reference data corresponding to a reference dresser load close to the set dresser load and pad height reference data corresponding to a reference dresser load close to the reference load, wherein the pad height reference data is provided for any of a plurality of types of the polishing member or for any of a plurality of types of a dressing surface of the dresser, and wherein a pad height $PadH_x$ corresponding to a set dresser load $DF_x$ is determined according to a formula:

$$PadH_x=(PadH_1-PadH_2)/(DF_1-DF_2)\times(DF_x-DF_2)+PadH_2$$

wherein $DF_1$ and $DF_2$ are two dresser loads close to the $DF_x$, and $PadH_1$ and $PadH_2$ are pad height reference data corresponding to the dresser loads $DF_1$ and $DF_2$.

8. The non-transitory computer-readable recording medium of claim 7, wherein the polishing member is a polishing pad and the polishing apparatus is a semiconductor polishing apparatus.

* * * * *